US006651971B2

(12) United States Patent
Tsuei

(10) Patent No.: US 6,651,971 B2
(45) Date of Patent: Nov. 25, 2003

(54) PAPER COLLECTING DEVICE

(75) Inventor: Ji-Mei Tsuei, Hsinchu (TW)

(73) Assignee: Umax Data Systems, Inc., Hsinchu (TW)

( * ) Notice: Subject to any disclaimer, the term of this patent is extended or adjusted under 35 U.S.C. 154(b) by 29 days.

(21) Appl. No.: 10/045,898

(22) Filed: Jan. 11, 2002

(65) Prior Publication Data

US 2003/0132566 A1 Jul. 17, 2003

(51) Int. Cl.[7] ..... B65H 3/34
(52) U.S. Cl. ..... 271/109
(58) Field of Search ..... 271/109, 116, 271/117, 125, 167, 104, 121, 137, 122; B65H 3/34, 3/52, 3/06

(56) References Cited

U.S. PATENT DOCUMENTS 5,497,986 A * 3/1996 Kudo ..... 271/122
6,024,356 A * 2/2000 Tanaka et al. ..... 271/10.13
6,390,463 B1 * 5/2002 Iwago ..... 271/118

* cited by examiner

*Primary Examiner*—Donald P. Walsh
*Assistant Examiner*—Kenneth W Bower
(74) *Attorney, Agent, or Firm*—J.C. Patents

(57) ABSTRACT

A paper collecting device, comprising a separation roller, a drive roller, a feed roller, a support member, and an elastic member. In addition to the separation having a one-way clutch, the feed roller also has an extra one-way clutch added between the feed gear and the feed rim. When the paper separation process stops and the separation roller instantaneously reverses rotation, the two one-way clutches will disengage and allow the separation roller and feed roller to detach from the driving source of the motor. This will allow the separation roller and feed roller to rotate freely and possess the same tangential velocity to prevent paper from being pushed or pulled causing paper wrinkle or tear. Moreover, the diameter of the feed rim is smaller in design than the separation rim. The paper collecting device also comprising a paper blocking mechanism located on the support member above the frame to prevent paper overly pushed inside.

16 Claims, 4 Drawing Sheets

PAPER COLLECTING DEVICE

BACKGROUND OF THE INVENTION

1. Field of Invention

This present invention relates to a paper collecting device, and more particularly to a paper collecting mechanism used in an automatic document feeder.

2. Description of Related Art

In common visual imaging output devices such as photocopying machine, fax machine, scanners or the like, image reading is accomplished by placing the original document on top of a glass platen. The optical reading unit is placed underneath the glass platen for reading the image of the original document. Due to increase usage of the automatic document feeder (herein after abbreviated as ADF) to feed original documents into the photocopying machine for images to be read, the position of the optical reading unit can be better defined and therefore reducing the area of the glass platen. The other application of the ADF is to place it on top of the glass platen. The stacked original documents are placed inside the tray of the ADF allowing the paper collecting device inside the ADF to feed the document to the glass platen for image reading. Furthermore, ADFs are applicable to printers or other machines that require paper separation.

FIG. 1 and FIG. 2 are the schematic diagrams of a conventional paper collecting device. The paper collecting device 100 has a separation roller 110, a drive roller 120, and a feed roller 130, a support member 140, and a elastic member 150 supported between top wall 20 bottom wall 30. Paper 10 feeds under the feed roller 130 in a forward direction as indicated by the arrow. Support member is seated horizontally and is connected to separation shaft 112, drive shaft 122, and feed shaft 132. When separation roller 112 rotates, it will also rotate drive roller 120, feed roller 130, and support member down around separation shaft 112 and extend elastic member 150 to press down feed rim 136 to contact the surface of paper 10, as illustrated in FIG. 2. The continuous rotation of separation gear 114 rotates drive gear 124 to turn feed gear 134 and feed rim 136, which are both mounted on feed shaft 132. As a result, feed gear 134 rotates feed rim 136 and feeds the paper forward.

Please refer to FIG. 2, when paper 10 is fed in by feed rim 136 till it is between separation rim 116 and bottom wall 30, the continuous rotating separation gear 114 engages the one-way clutch 118 to turn separation rim 116. Once the separation process of paper 10 is finished, rotating separation rim 116 will immediately reverse rotation in the other direction to operate other parts. At this moment, one-way clutch 118 activates and releases separation rim 116 from separation gear 114 to allow free rotation. This will prevent separation rim 116 from pushing paper 10 in the reverse direction and causing paper wrinkle. At the same time, elastic member 150 will retract support member 140, feed roller 130, and drive roller 120, and prevent separation 136 from pushing paper 10 in. Afterwards, separation gear 114 stops rotating and returns the paper collecting device back to the state in FIG. 1.

The disadvantage of the conventional paper collecting device in FIG. 2 is paper wrinkle and tear. When paper 10 leaves separation rim 116, separation 112 immediately reverses rotation causing one-way clutch 118 to activate and to release separation rim 116 from separation shaft 112. This prevents separation rim 116 to further push in paper 10 for separation process. At the same time, elastic member 150 retracts support member 140, feed roller 130, and drive roller 120. If elastic member 150 cannot instantaneously retract and because separation gear 114 is still causing separation rim 116 to turn, feed rim 136 will either push or pull paper 10 and cause wrinkle or tear because of the different velocity of feed rim 136 and separation rim 116. Moreover in designing the device, the dimensions of separation rim 116 and feed rim 136 have to be the accurately identical. If the dimensions differ in separation rim 116 and feed rim 136, the linear velocity of paper 10 is unequal and will easily cause paper 10 to have wrinkle or tear.

SUMMARY OF THE INVENTION

An object of the present invention is to provide to a paper collecting device suitable to use in an ADF. It can accommodate separation rims and feed rims of different sizes and still maintain the same linear velocity for the paper at contact with the separation rim and feed rim to prevent pushing or pulling of paper causing paper wrinkle and tear.

In order to achieve the above object, a paper collecting device suitable to use in an ADF comprises a separation roller, a drive roller, a feed roller, a support member, and an elastic member. In this device, besides the separation roller having a one-way clutch, another one-way clutch is added in between the feed roller and feed gear. When feeding process of the paper stops, the separation shaft immediately reverses rotation to operate other parts. This will cause the separation rim and the feed rim to release from the driving source of the motor and allow them to rotate freely at the same tangential velocity. As a result, the paper is prevented from pushing or pulling by the feed rim, which causes paper wrinkle and tear.

Furthermore, the device in this invention allows the diameter of the feed rim to be smaller than the separation rim. The tangential velocity at the points of contact of the paper and the separation rim and the feed rim should be the same. However due to the feed rim having a smaller diameter than the separation rim, the tangential velocity of the separation rim is larger than the tangential velocity of the feed rim because the gear ratio between the separation gear and the feed gear is identical so the separation gear, separation rim, and feed gear all have the same angular velocity. Therefore in order to maintain the same tangential velocity at the points of contact of the paper and the separation rim and the feed rim, the one-way clutch inside the feed roller automatically disengages to allow the feed rim to rotate freely. This maintains a same tangential velocity when the same piece of paper contact the separation rim and the feed rim during the conveyance of the paper from the feed rim to the separation rim to prevent paper being pushed or pulled causing paper wrinkle and tear.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DETAILED DESCRIPTION OF THE PREFERRED EMBODIMENTS

Figure 1:
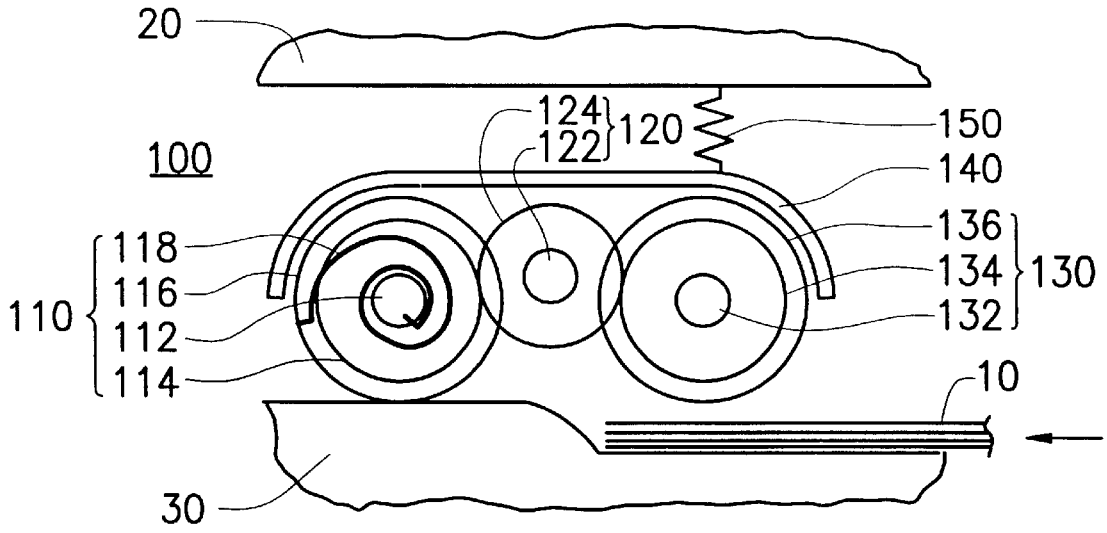
FIG. 1 (PRIOR ART)
FIG. 1 and FIG. 2 are schematic diagrams of the operation of a conventional paper collecting device
Figure 2:
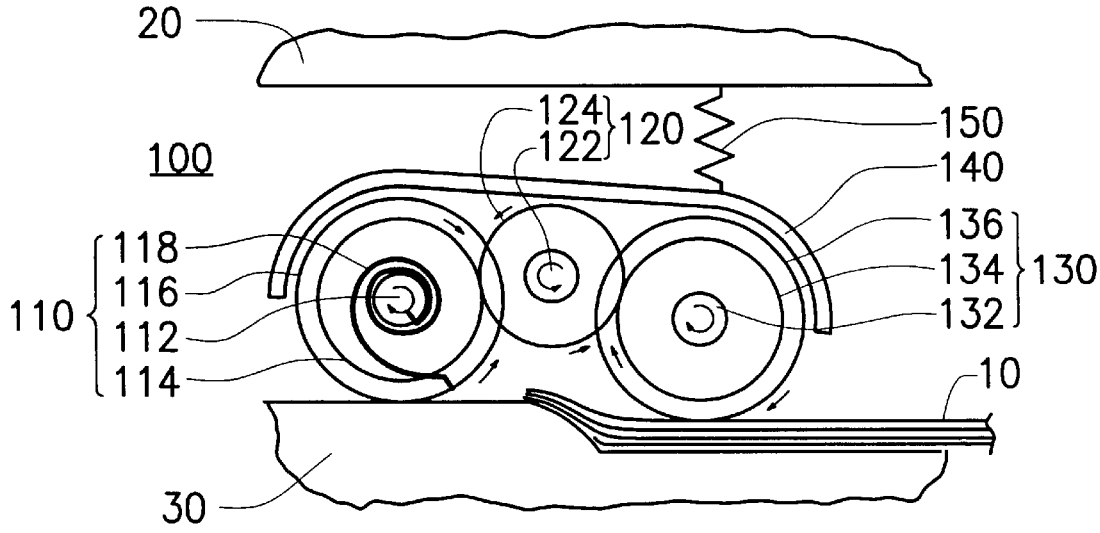
FIG. 2 (PRIOR ART)
Figure 3:
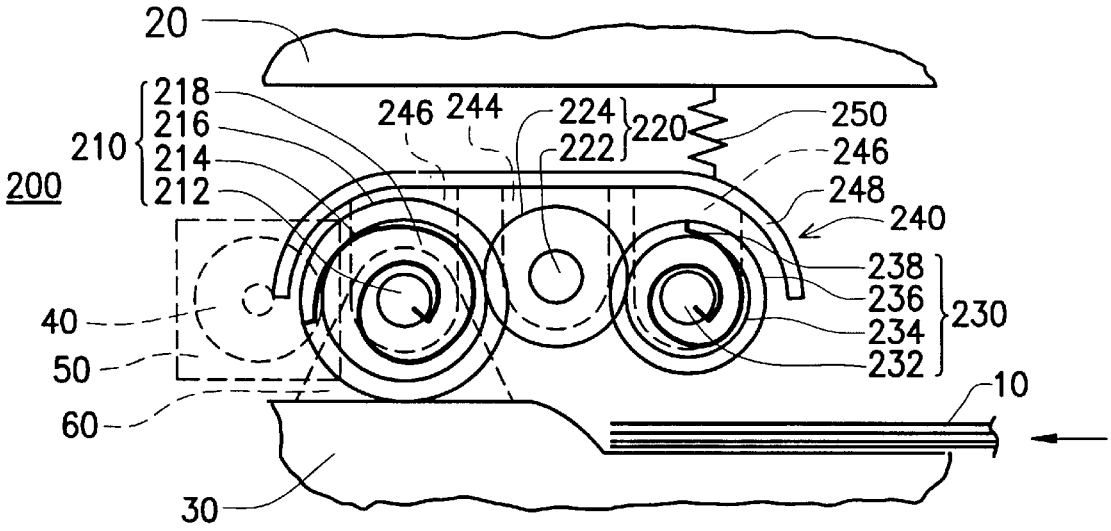
FIG. 3 and FIG. 4 are schematic diagrams of the operation of a preferred embodiment of this invention.
Figure 4:
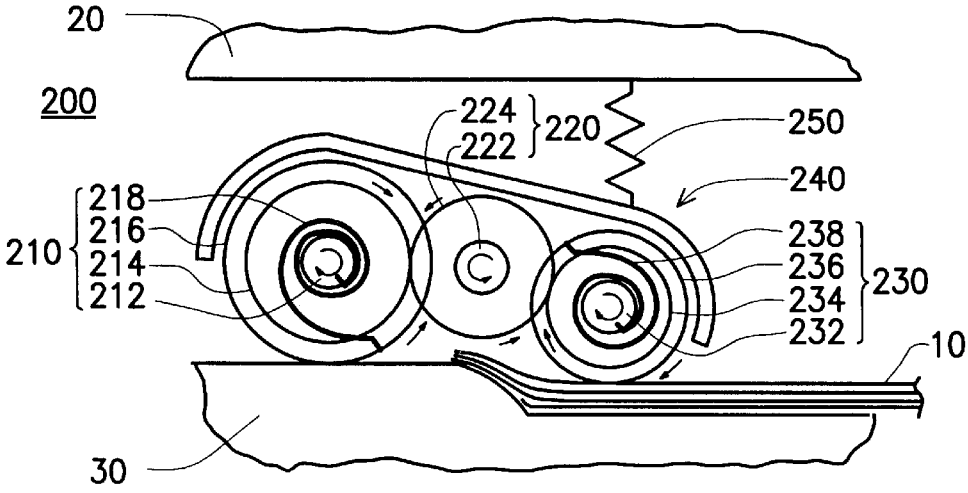

Please refer to FIG. 3 and FIG. 4, FIG. 4 is a simplified diagram of FIG. 3. The paper collecting device comprises a separation roller 210, a drive roller 220, a feed roller 230, a support member 240, and an elastic member 250. Separation roller 210 is located in the ADF between top wall 20 and bottom wall 30. Separation roller 210 comprises a separation shaft 212, a separation gear 214, a separation rim 216, and a one-way clutch 218 such as a spring-type one-way clutch. Wherein, separation gear 214 is coupled to separation shaft 212 and further to separation rim 26 via one-way clutch 218. When separation gear 214 rotates in the direction indicated in the diagram, it will also engage one-way clutch 218 at the same time to drive separation rim 216 in the same direction. One-way clutch 218 is designed so that the direction of rotation when engaged is the same as the direction the paper enters. Furthermore, the separation gear 214 and the separation rim 216 rotate around the separation shaft 212, and the separation rim briefly touches bottom wall 30.

Please refer to FIG. 3, drive roller 220 is also located between top wall 20 and bottom wall 30. Drive roller 220 comprises a drive shaft 222 and a drive gear 224 and drive roller 220 is coupled to drive gear 224 and rotates around drive shaft 222, which is approximately parallel to separation shaft 212. Drive gear 224 is coupled to separation gear 214.

Please continue to refer to FIG. 3, feed roller 230 is also located between top wall 20 and bottom wall 30. Feed roller 230 comprises a feed shaft 232, a feed gear 234, a feed rim 236, and a one-way clutch 238 such as a spring-type one-way clutch. Feed gear 234 and feed rim 236 are connected to feed shaft 232, which is approximately parallel to separation shaft 213. The first coupling method of one-way clutch 238 is between feed gear 234 and feed rim 236. The second coupling method of one-way clutch 238 is between feed shaft 232 and feed rim 236 where the feed shaft 232 is attached to feed gear 234. Please note that the first coupling method is used in the embodiment of this invention.

In FIG. 3, when feed shaft 232 rotates in the direction as indicated in the diagram, it will engage one-way clutch 238 at the same time to drive feed rim 236 in the direction of rotation. One-way clutch 238 is designed so that the direction of rotation is the same as the direction the paper enters. Furthermore, feed gear 234 and feed rim 236 rotate around feed shaft 232 and feed gear 234 is coupled to drive gear 224.

Also in FIG. 3, support member 240 comprises a separation shaft bearing 242, a drive shaft bearing 244, a feed shaft bearing 246, and a frame 248. Frame 248 is located between top frame 20 and separation roller 210, drive roller 220, and feed roller 230. Wherein, separation shaft bearing 242, drive shaft bearing 244, and feed shaft bearing 246 are all coupled to frame 248. Separation shaft 212 is coupled to separation shaft bearing 242, drive shaft 222 is coupled to drive shaft bearing 244, and feed shaft 232 is coupled to feed shaft bearing 246. Furthermore, an elastic member 250 such as a spring connects frame 248 and top wall 20.

The operation of the preferred embodiment of this invention will be discussed in the following. Please refer to FIG. 3 and FIG. 4, separation gear 214 is coupled to a main drive gear 40, which is connected to a motor 50. Separation shaft 212 is coupled to rotational shaft bearing 60 of the ADF. When motor 50 drives the main gear 40, it will drive separation gear 214 causing the support member 240, drive roller 220, and feed roller 230 to pivot on separation shaft 212 to rotate clockwise and pull downwards. At this moment, feed rim 236 continues to pull down to make contact with the surface of paper 10 and extends the elastic member 250, as shown in FIG. 4.

In FIG. 3 and FIG. 4, when main drive gear 40 drives separation gear 214 and separation shaft 212, one-way clutch 218 is engaged and it drives the separation rim 216. Furthermore, main drive gear 40 drives separation gear 214 so to turn drive gear 224, and feed gear 234, and to engage one-way clutch 238. As a result, when main drive gear 40 is driven by motor 50, feed rim 236 is pulled downwards by the driving force to make contact with paper 10, as shown in FIG. 4. Feed rim 236 and separation rim 216 rotate at the same time so feed rim 236 feeds a plurality of paper 10 forward, and separation rim outputs paper 10 one by one.

Please refer to FIG. 4, when paper 10 touches both separation rim 216 and feed rim 236, the tangential velocity at the two contact points of paper 10 with separation rim 216 and feed rim 236 have to be identical. Due to a smaller radius of feed rim 236 than separation rim 216, feed rim 236 has a larger angular velocity than separation rim 216 because their tangential velocities remain constant. Since separation rim 216 and separation gear 214 have the same angular velocity so feed gear 234 also has the same angular velocity. As a result, the angular velocity of feed rim 236 is larger than feed gear 234 causing one-way clutch 238 to disengage to allow feed rim 236 to rotate freely so the tangential velocity of feed rim 236 can match the tangential velocity of separation rim 216. Therefore paper 10 is conveyed at a linear velocity through separation rim 216 feed rim 236 to prevent paper wrinkle or tear.

In FIG. 3 and FIG. 4, when the operation of paper separation stops, motor 50 will instantaneously reverses causing separation gear 214 to reverse rotation. One-way clutch 218 and 238 will allow separation rim 216 and feed rim 236 to separate from the driving source of motor 50 to rotate freely allowing paper 10 to have the same linear velocity to prevent paper wrinkle and tear.

Figure 5:
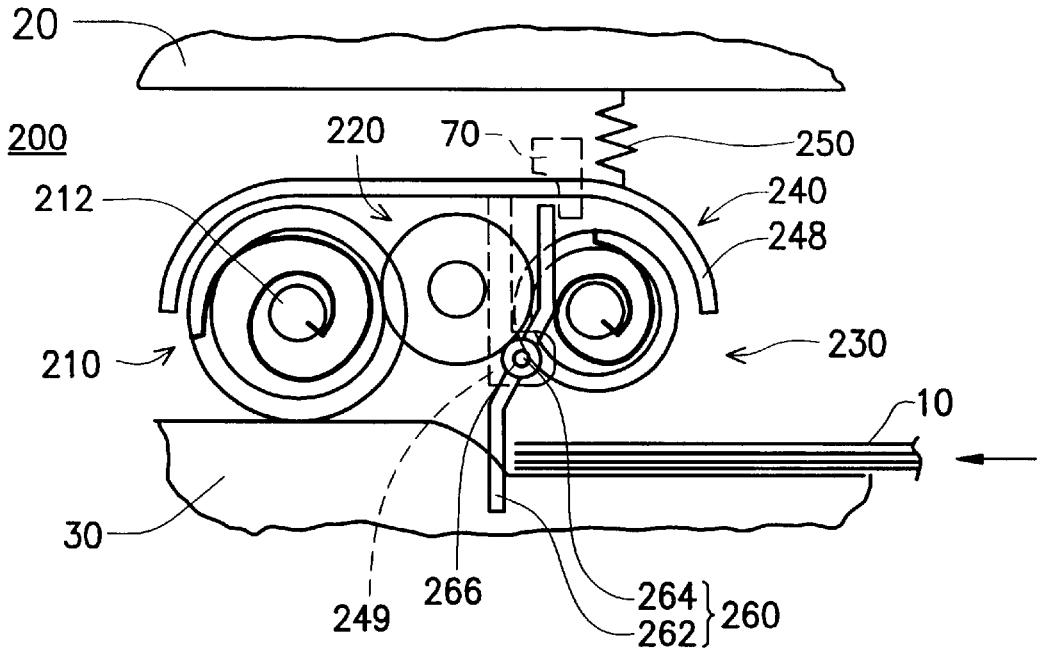
FIG. 5 and FIG. 6 are schematic diagrams of the paper collecting device in FIG. 3 and FIG. 4 illustrating a paper blocking mechanism.
Figure 6:
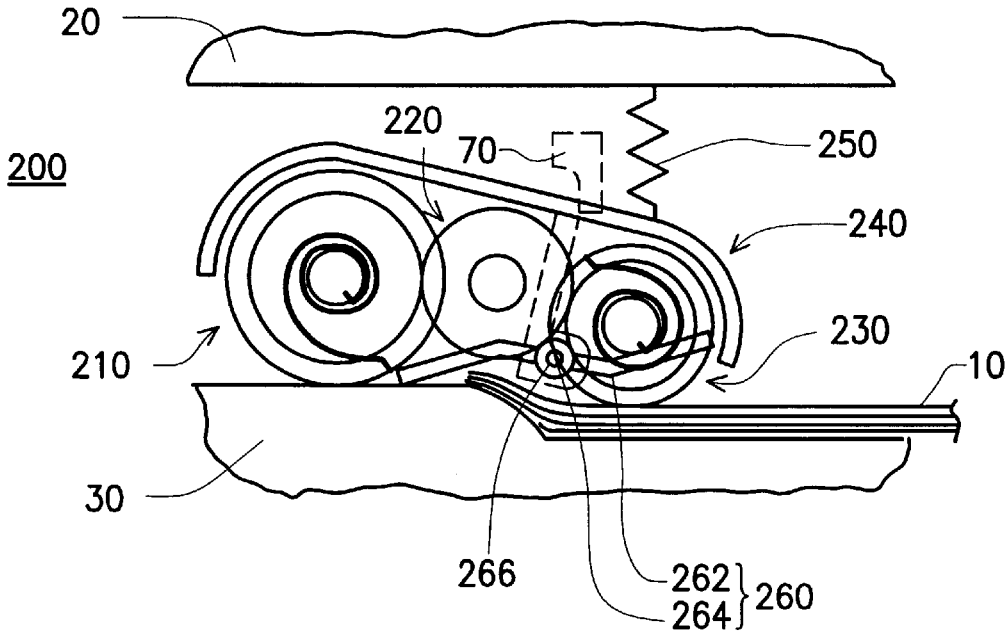
Figure 7:
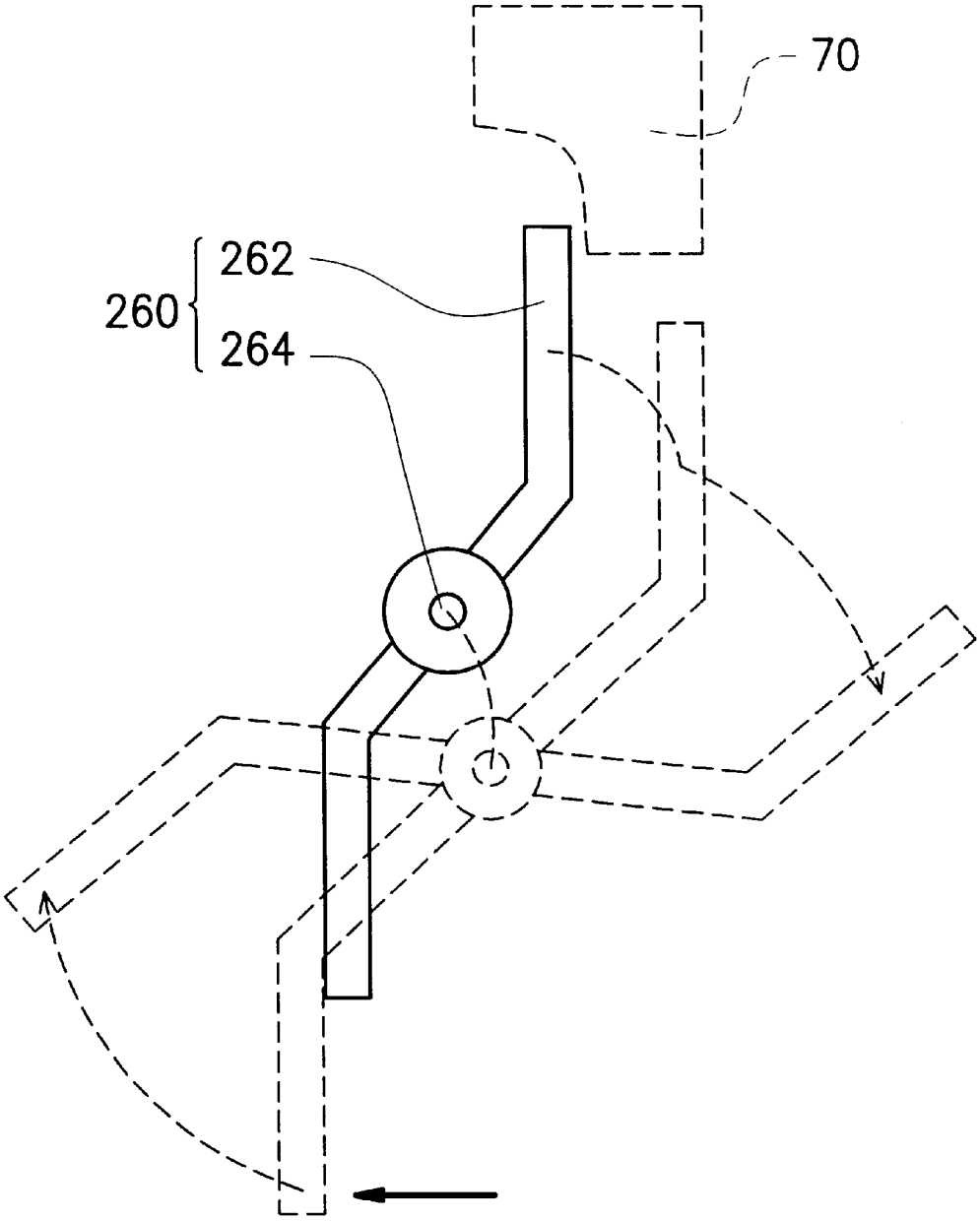
FIG. 7 is a schematic diagram of the operation of the paper blocking mechanism.

Please refer to FIG. 5 and FIG. 6, paper collecting device 200 further comprises a paper blocking mechanism 260, which comprises a paper blocking arm 262 and a shaft 264. Wherein, shaft 264 is approximately parallel to separation shaft 212 and protrudes from the surface of an extension 249 of frame 248. Paper blocking arm 262 has a shaft hole 266, which penetrates through the two sides of paper blocking arm 262 and it is loosely fitted on shaft 264. Please refer to FIG. 7, when the operation stops, a stopper 70 is located on top wall 20 in the path of rotation of paper blocking arm 262. The top of paper blocking arm 262 barely touches stopper 70 and the bottom of paper blocking arm 262, which is close to bottom wall 30, blocks the entry of paper 10. In FIG. 6 and FIG. 7, when the operation starts, the top of paper blocking arm 262, which is close to top wall 20, will separate from stopper 70 so paper 10, fed in by the rotation of fed rim 236, pushes paper blocking arm 262 upwards. When the operation stops again, paper blocking arm 262 returns to its initial position in FIG. 5 due to force of gravity because the bottom of paper blocking arm 262 is heavier in design.

The paper collecting device in this invention not only has a one-way clutch installed in the separation roller but has an additional one-way clutch installed in the feed roller between the feed gear and feed rim. At the instant when the operation of paper separation stops and the separation gear reverses, both the separation rim and feed rim detach from the driving source of the motor causing them to rotate freely to maintain the same linear velocity. This prevents the paper from being pushed or pulled so to avoid paper wrinkle or tear.

The paper collecting device in this invention comprises an extra one-way clutch in the feed roller between the feed gear and feed rim. This allows the dimension of the separation roller and feed roller to be different and still be able to maintain the same linear velocity to prevent the paper being pushed or pulled. Since the size of the feed roller is smaller, the cost of raw material can be reduced.

The paper collecting device in this invention further comprises a paper blocking mechanism used to prevent the paper from being pushed too far in before the paper collecting device starts to operate causing paper jam.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A paper collecting device suitable to use in an automatic document feeder for conveying papers, comprising:

a separation roller mounted in the device for separating and outputting papers, further comprising:

a first clutch;

a means for coupling the first clutch to the separation roller;

a means for controllably coupling rotational movement from a rotational energy source to the separation roller;

a drive roller mounted in the device for transferring rotational movement from the separation roller to the drive roller from the rotational movement source, further comprising:

a means for controllably coupling rotational movement from the separation roller to the drive roller;

a feed roller of a different size from the separation roller mounted in the device for feeding or inputting papers into the device, further comprising:

a second clutch;

a means for coupling the second clutch to the feed roller;

a means for controllably coupling rotational movement from the drive roller to the feed roller from the rotational movement source via the separation roller; and a support member mounted in the device for supporting the separation roller, the drive roller, and the feed roller, further comprising:

a frame;

a means for coupling the separation roller to the frame;

a means for coupling the drive roller to the frame;

a means for coupling the feed roller to the frame;

a paper blocking mechanism comprising a paper blocking arm and a shaft, wherein the paper blocking arm has a hole that penetrates both sides of the paper blocking arm and the paper blocking arm is coupled to the shaft via the hole.

2. The device in claim 1, wherein the separation roller further comprises a first rim and the feed roller further comprises a second rim.

3. The device in claim 2, wherein the first clutch is coupled to the first rim and the second clutch is coupled to the second rim.

4. The device in claim 1, wherein the first clutch and the second clutch engage in the direction of paper entry.

5. The device in claim 1, wherein the means for controllably coupling rotational movement from a rotational movement source to the separation roller includes a gear, the means for controllably coupling rotational movement from the separation roller to the drive roller includes a gear, and the means for controllably coupling movement energy from the drive roller to the feed roller is a gear.

6. The device in claim 5, wherein the elastic member includes a spring.

7. The device in claim 1, wherein the means for coupling the separation roller to the frame includes a shaft bearing, the means for coupling the drive roller to the frame includes a shaft bearing, and the means for coupling the feed roller to the frame includes a shaft bearing.

8. The device in claim 1, wherein the device further comprises an elastic member coupled to the frame of the support member.

9. The device in claim 1, wherein the rotational movement source includes a motor.

10. The device in claim 1, wherein a radius of the feed roller is smaller than the separation roller.

11. The device in claim 1, wherein a center of the separation roller is approximately parallel to a center of the feed roller.

12. A paper collecting device suitable to use in an automatic document feeder for conveying papers comprising:

a separation roller mounted in the device for separating and outputting papers, further comprising:

a first one-way clutch;

a means for coupling the first clutch to the separation roller;

a means for controllably coupling rotational movement from a rotational energy source to the separation roller;

a drive roller mounted in the device for transferring rotational movement from the separation roller to the drive roller from the rotational movement source further comprising:

a means for controllably coupling rotational movement from the separation roller to the drive roller;

a feed roller of a smaller diameter than the separation roller mounted in the device for feeding or inputting papers into the device, further comprising:

a second one-way clutch;

a means for coupling the second clutch to the feed roller;

a means for controllably coupling rotational movement from the drive roller to the feed roller from the rotational movement source via the separation roller; and a support member mounted in the device for supporting the separation roller, the drive roller, and the feed roller, further comprising:

a frame;

a means for coupling the separation roller to the frame;

a means for coupling the drive roller to the frame;

a means for coupling the feed roller to the frame;

a paper blocking mechanism, further comprising a paper blocking arm and a shaft, wherein the paper blocking arm has a hole that penetrates both sides of the paper blocking arm and the paper blocking arm is coupled to the shaft via the hole.

13. The device in claim 12, wherein the means for controllably coupling rotational movement from a rotational movement source to the separation roller includes a first gear, the means for controllably coupling rotational movement from the separation roller to the drive roller includes a second gear, and the means for controllably coupling movement energy from the drive roller to the feed roller is a third gear.

14. The device in claim 13, wherein the first one-way clutch is coupled to the first gear and the second one-way clutch is coupled to the third gear.

15. The device in claim 14, wherein the first clutch is a spring-type clutch and the second clutch is a spring-type clutch.

16. A paper collecting device suitable to use in an automatic document feeder for conveying papers, comprising:

a separation roller mounted in the device for separating and outputting papers, further comprising:

a first clutch;

a means for coupling the first clutch to the separation roller;

a means for controllably coupling rotational movement from a rotational energy source to the separation roller;

a drive roller mounted in the device for transferring rotational movement from the separation roller to the drive roller from the rotational movement source, further comprising:

a means for controllably coupling rotational movement from the separation roller to the drive roller;

a feed roller of a different size from the separation roller mounted in the device for feeding or inputting papers into the device, further comprising:

a second clutch, wherein the first clutch and the second clutch engage in the direction of paper entry;

a means for coupling the second clutch to the feed roller;

a means for controllably coupling rotational movement from the drive roller to the feed roller from the rotational movement source via the separation roller; and a support member mounted in the device for supporting the separation roller, the drive roller, and the feed roller, further comprising:

a frame;

a means for coupling the separation roller to the frame;

a means for coupling the drive roller to the frame;

a means for coupling the feed roller to the frame.

* * * * *